US011505985B2

(12) United States Patent
Hsieh

(10) Patent No.: US 11,505,985 B2
(45) Date of Patent: Nov. 22, 2022

(54) DEVICE FOR RELEASING AND RESETTING A FIRE AND SMOKE BARRIER

(71) Applicant: Chung Hsien Hsieh, New Taipei (TW)

(72) Inventor: Chung Hsien Hsieh, New Taipei (TW)

( * ) Notice: Subject to any disclaimer, the term of this patent is extended or adjusted under 35 U.S.C. 154(b) by 472 days.

(21) Appl. No.: 16/728,038

(22) Filed: Dec. 27, 2019

(65) Prior Publication Data

US 2020/0399948 A1 Dec. 24, 2020

(30) Foreign Application Priority Data

Jun. 24, 2019 (TW) ..... 108121911

(51) Int. Cl.
*E05F 15/00* (2015.01)
*E05F 15/72* (2015.01)
*E05F 15/635* (2015.01)

(52) U.S. Cl.
CPC ..... *E05F 15/72* (2015.01); *E05F 15/635* (2015.01); *E05Y 2201/264* (2013.01); *E05Y 2201/462* (2013.01); *E05Y 2900/134* (2013.01)

(58) Field of Classification Search
CPC .. E05F 15/72; E05F 15/636; E05Y 2201/264; E05Y 2201/462; E05Y 2900/134; E05Y 2800/254
USPC ..... 49/1, 5, 6
See application file for complete search history.

(56) References Cited

U.S. PATENT DOCUMENTS 5,673,514 A * 10/1997 McKeon ..... A62C 2/24 49/30
6,055,885 A * 5/2000 Shea ..... E06B 9/74 49/140
7,275,631 B2 * 10/2007 Hsieh ..... E06B 9/82 188/164
7,293,805 B1 11/2007 Hsieh
(Continued)

FOREIGN PATENT DOCUMENTS

CN 201517359 U 6/2010
CN 203756009 U 8/2014
(Continued)

OTHER PUBLICATIONS

TW Office Action dated Dec. 30, 2019 in corresponding Taiwan application (No. 108121911).
(Continued)

*Primary Examiner* — Jerry E Redman
(74) *Attorney, Agent, or Firm* — McClure, Qualey & Rodack, LLP

(57) ABSTRACT

The invention relates to a device for releasing and resetting a fire and smoke barrier. In a normal use state, a clutch member is held by an electromagnetic attraction unit, so that a push rod ejecting module cannot be actuated, and a door operator is controlled by a clutch module thereof. Upon power failure, for example upon an accident, the clutch member is released by the electromagnetic attraction unit, and a barrier release member is activated by the push rod ejecting module so as to shut the fire and smoke barrier. Upon power restoration, the clutch member is attracted and
(Continued)

held by the electromagnetic attraction unit, and the push rod ejecting module is reset by a push rod resetting module. At the same time, the barrier release member is also reset.

10 Claims, 9 Drawing Sheets

(56) References Cited

U.S. PATENT DOCUMENTS

| | | | | |
|---|---|---|---|---|
| 7,699,144 | B2 * | 4/2010 | Hsieh | E05F 1/006 160/9 |
| 8,230,759 | B2 * | 7/2012 | Hsieh | E05F 15/665 49/140 |
| 8,397,787 | B1 * | 3/2013 | Daus | E06B 5/16 160/1 |
| 8,484,897 | B2 * | 7/2013 | Hsieh | E06B 9/74 160/8 |
| 8,567,573 | B2 * | 10/2013 | Hsieh | E06B 9/84 160/9 |
| 8,807,294 | B2 | 8/2014 | Hsieh | |
| 8,985,181 | B2 * | 3/2015 | Hsieh | E05F 15/72 160/310 |
| 9,162,094 | B2 * | 10/2015 | Hsieh | A62C 2/247 |
| 9,376,864 | B2 * | 6/2016 | Hsieh | E06B 9/08 |
| 11,111,723 | B2 * | 9/2021 | Hsieh | A62C 2/18 |
| 11,261,660 | B2 * | 3/2022 | Hebeisen | E06B 9/50 |
| 2006/0124250 | A1 * | 6/2006 | Hsieh | E06B 9/82 160/9 |
| 2012/0024484 | A1 * | 2/2012 | Hsieh | E06B 9/74 160/291 |
| 2013/0025804 | A1 * | 1/2013 | Hsieh | E05F 15/72 160/305 |
| 2014/0318719 | A1 * | 10/2014 | Hsieh | E06B 9/42 160/133 |
| 2017/0167194 | A1 * | 6/2017 | Freberg | E06B 9/90 |
| 2020/0080373 | A1 * | 3/2020 | Hsieh | E06B 9/80 |

FOREIGN PATENT DOCUMENTS

| | | | |
|---|---|---|---|
| CN | 203947944 | U | 11/2014 |
| JP | 2011185035 | A | 9/2011 |
| JP | 2012140851 | A | 7/2012 |
| TW | 200724771 | A | 7/2007 |
| TW | 201305426 | A | 2/2013 |
| TW | 201309892 | A | 3/2013 |

OTHER PUBLICATIONS

Search Report issued in TW Office Action dated Dec. 30, 2019 in corresponding Taiwan application (No. 108121911).

Examination report No. 1 for standard AU patent application (No. 2020200280) dated Apr. 16, 2021.

Singapore Written Opinion dated Aug. 31, 2020 in application No. 10201913390X.

Search Report issued in Singapore Written Opinion dated Aug. 31, 2020 in application No. 10201913390X.

* cited by examiner

DEVICE FOR RELEASING AND RESETTING A FIRE AND SMOKE BARRIER

BACKGROUND OF THE INVENTION

Field of the Invention

The present invention relates to a device for releasing and resetting a fire and smoke barrier, in particular to a device capable of releasing a fire and smoke barrier in an emergency, and automatically resetting the fire and smoke barrier when the emergency is terminated, and relates to a door operator equipped with such a device.

Description of the Related Art

In case of emergency, for example, in case of fire, shutting of a traditional fire and smoke barrier is usually triggered by a fusible link. When the fusible link is molten and broken due to fire heat, the barrier falls down due to its weight. Related technology is disclosed in U.S. Pat. No. 8,567,573 (Patent literature 1), titled "Door Operator of Fireproof Door." As shown in FIGS. 3a and 3b of the Patent literature 1, when a fusible link is molten at a high temperature, a shift lever is hit by a sliding member leftward biased by a potential energy of an elastic member so as to release a fire door.

However, the fusible link is a disposable product which cannot be recovered once it is broken and must be replaced with a new one. Moreover, there are doubts about reliability of the fusible link. That is, it may be broken by external forces, resulting in unexpected actions. The mechanical properties of the fusible link may be changed if a tension force is applied to the fusible link for a long time. For example, the fusible link unexpectedly breaks when no fire accident occurs, or the fusible link cannot be molten and broken when a fire accident occurs. It is more important that once the fusible link is broken, the fire door release device cannot be automatically reset. For example, for the device of the Patent literature 1, resetting of the fire door release device is quite inconvenient because it is necessary to manually pull back the shift lever and the sliding member and then replace the broken fusible link with a new one.

Furthermore, the applicant of the present invention has developed a resettable safety door release device, as disclosed in U.S. Pat. No. 7,293,805 (Patent literature 2), titled "Safety Door Central Release Device", in which an electromagnetic device is used for controlling the actuation of a release mechanism. Specifically, as shown in FIG. 3(A) of the Patent literature 2, one end of a cord must be first pulled to a position close to the jaws of the release mechanism and then clamped by the jaws of the release mechanism which are actuated by electrically energizing the electromagnetic device, as shown in FIG. 3(B). Furthermore, in case of fire or other emergencies, the cord is released from the jaw of the release mechanism by electrically deenergizing the electromagnetic device, thereby closing the safety door.

Although the device of the Patent literature 2 is capable of clamping or releasing the cord repeatedly by the jaws of the release mechanism the stroke distance caused by the magnetic attraction effect is rather limited so that it is unable to realize a long-distance reset. Owing to the distance and the need to overcome the spring force, a higher voltage for the electromagnetic device is required during resetting. Resetting of the cord is quite inconvenient because the process for resetting the cord is manually carried out, and the door operator is usually installed at a high place and is not convenient for personnel to operate.

SUMMARY OF THE INVENTION

The main object of the present invention is to provide a device for releasing and resetting a fire and smoke barrier capable of releasing the fire and smoke barrier quickly and realizing the long-distance reset.

In order to achieve the above object, the present invention provides a device for releasing and resetting a fire and smoke barrier, which is used for actuating a barrier release member. The device mainly comprises an electromagnetic clutch module, a push rod ejecting module, and a push rod resetting module. The electromagnetic clutch module comprises an electromagnetic attraction unit and a clutch member. The electromagnetic attraction unit is provided to attract and hold the clutch member. The push rod ejecting module is coupled to the clutch member and stores an elastic potential energy sufficient to push the barrier release member. The push rod resetting module is coupled to the clutch member and provided to reset the push rod ejecting module. When the electromagnetic attraction unit is electrically deenergized, the clutch member is released by the electromagnetic attraction unit, and the barrier release member is pushed by the push rod ejecting module with aid of the elastic potential energy. When the push rod resetting module and the electromagnetic clutch module are electrically energized, the clutch member is attracted and held by the electromagnetic attraction unit, and the push rod ejecting module is reset by the push rod resetting module.

In other words, according to the present invention, the actuation of the push rod ejecting module and the push rod resetting module is controlled by means of the electromagnetic clutch module. In a normal use state, the clutch member is held by the electromagnetic attraction unit, so that the push rod ejecting module cannot be actuated. Upon power failure, for example upon an accident or a simulation test, the clutch member is released by the electromagnetic attraction unit, and the barrier release member is actuated by the push rod ejecting module to shut the fire and smoke barrier. Upon power restoration, the clutch member is attracted and held by the electromagnetic attraction unit, and the push rod ejecting module is reset by the push rod resetting module. Accordingly, the present invention is safe and reliable, and the stroke distance of the push rod ejecting module is not limited. Also, the present invention has low energy consumption because in a standby state, only a small current needs to be supplied to the electromagnetic attraction unit from an external power source or a battery module.

In order to achieve the above object, the present invention provides a device for releasing and resetting a fire and smoke barrier, which is used for actuating a barrier release member. The device mainly comprises a push rod ejecting module, an electromagnetic holding module and a push rod resetting module. The push rod ejecting module stores an elastic potential energy sufficient to push the barrier release member. The electromagnetic holding module and the push rod resetting module are coupled to the push rod ejecting module. When the electromagnetic holding module is electrically deenergized, the barrier release member is pushed by the push rod ejecting module with aid of the elastic potential energy. When the push rod resetting module and the electromagnetic holding module are electrically energized, the push rod ejecting module is reset by the push rod resetting module. The push rod ejecting module is attracted and held by the electromagnetic holding module, so that the barrier release member cannot be actuated.

According to the present invention, the push rod ejecting module is reset by means of the push rod resetting module, and the electromagnetic holding module is used for holding the push rod ejecting module so that the push rod ejecting module is unable to actuate the barrier release member. In a normal use state, the electromagnetic holding module holds the push rod ejecting module, so that the push rod ejecting module is unable to actuate the barrier release member. Upon power failure, for example upon an accident or a simulation test, the push rod ejecting module is released by the electromagnetic holding module, and the barrier release member is actuated by the push rod ejecting module to shut the fire and smoke barrier. Upon power restoration, the push rod ejecting module is reset by the push rod resetting module. If resetting of the push rod ejecting module is completed, the electromagnetic holding module is used for holding the push rod ejecting module.

DESCRIPTION OF THE PREFERRED EMBODIMENTS

Figure 1:
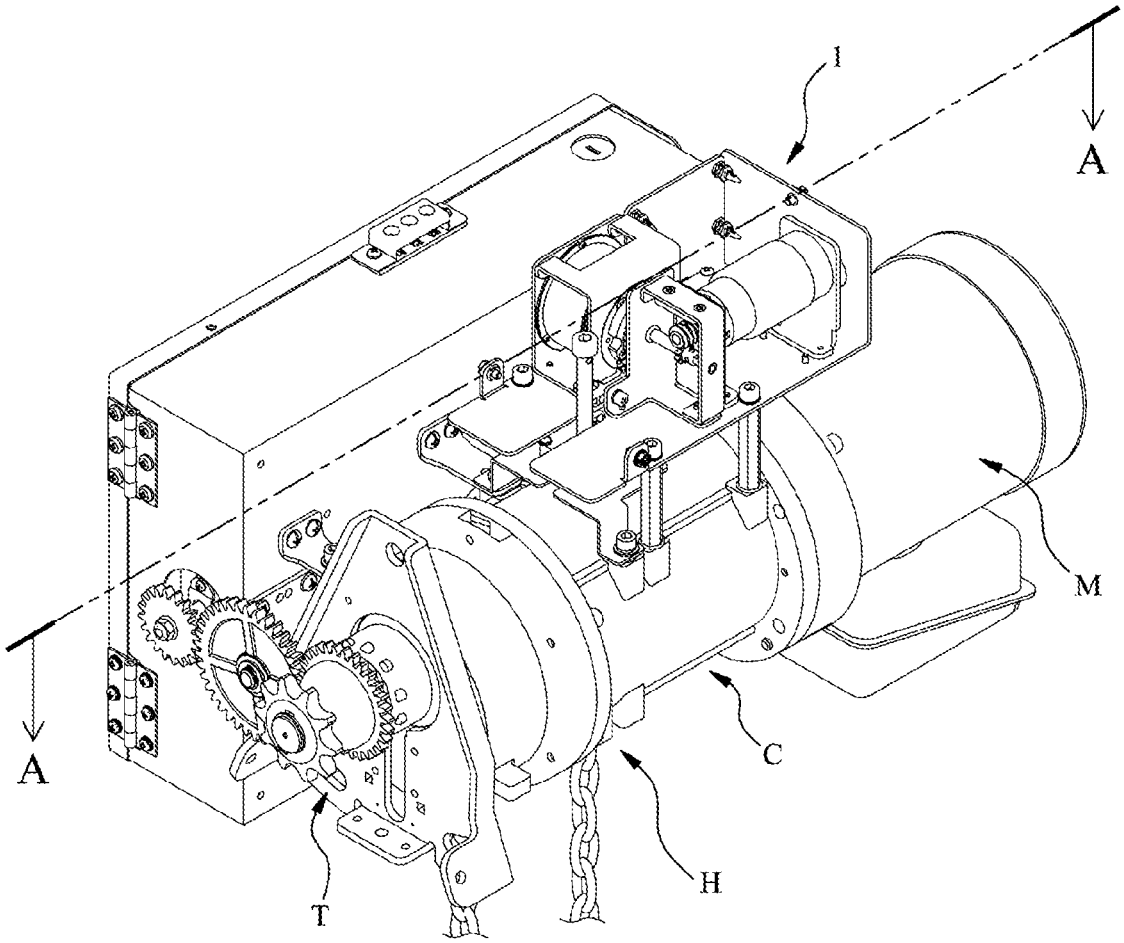
FIG. 1 is a perspective view of a door operator according to a first embodiment of the present invention.

In describing preferred embodiments of a device for releasing and resetting a fire and smoke barrier of the present invention in detail, it is noted that similar elements are designated by the same reference numerals. The drawings of the present invention are merely illustrative and are not necessarily drawn to scale, and all details are not necessarily shown in the drawings.

Figure 2:
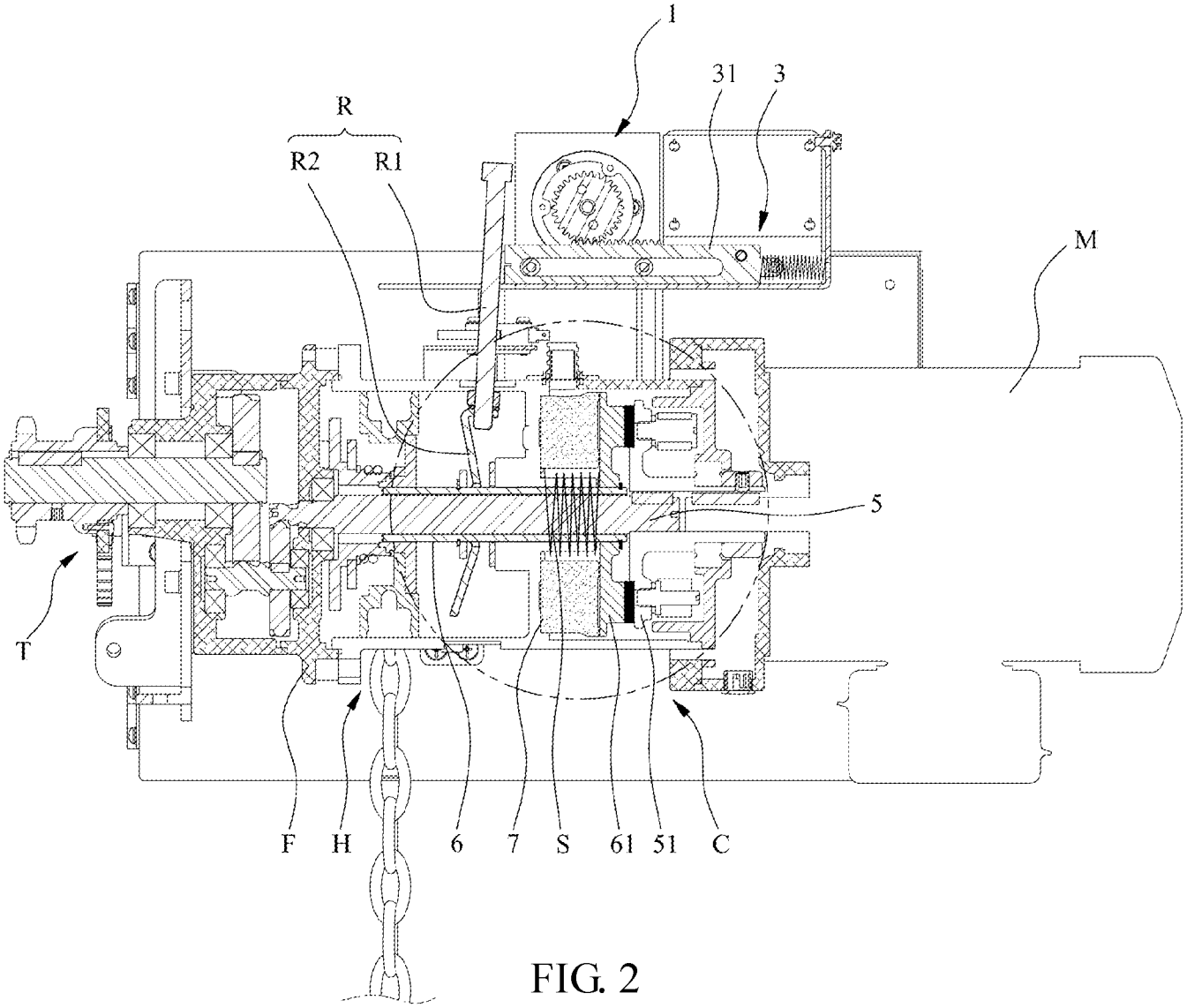
FIG. 2 is a cross-sectional view of the door operator according to the first embodiment of the present invention.

In describing an embodiment of the present invention, reference is made to FIGS. 1 and 2. FIG. 1 is a perspective view of a door operator according to a preferred embodiment of the present invention, and FIG. 2 is a cross-sectional view of the door operator according to the preferred embodiment of the present invention. As shown in FIG. 1, the door operator of this embodiment mainly includes a device 1 for releasing and resetting a fire and smoke barrier, a motor M, a clutch module C, a hand operated module H and a reducer module T. The motor M is mainly used to move the fire and smoke barrier so as to open or shut the fire and smoke barrier. The clutch module C is mainly used to switching various operating states such as a stationary state, an operation state and an emergency release state. The hand operated module H is provided to be manually operated by an operator so as to manually open the fire and smoke barrier in case of failure or emergency. The reducer module T is used to reduce the output speed of the motor M.

Figure 3:
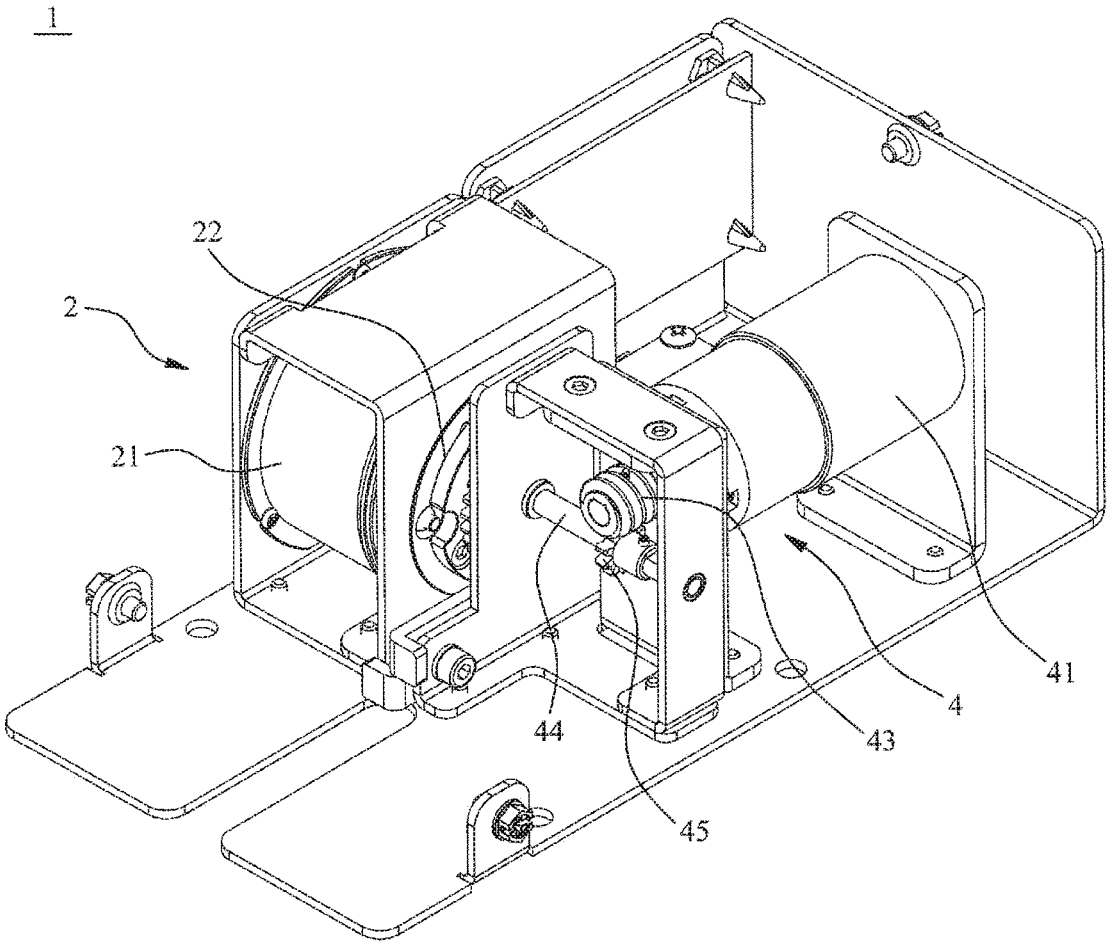
FIG. 3 is a perspective view of a device for releasing and resetting a fire and smoke barrier according to the first embodiment of the present invention.
Figure 4:
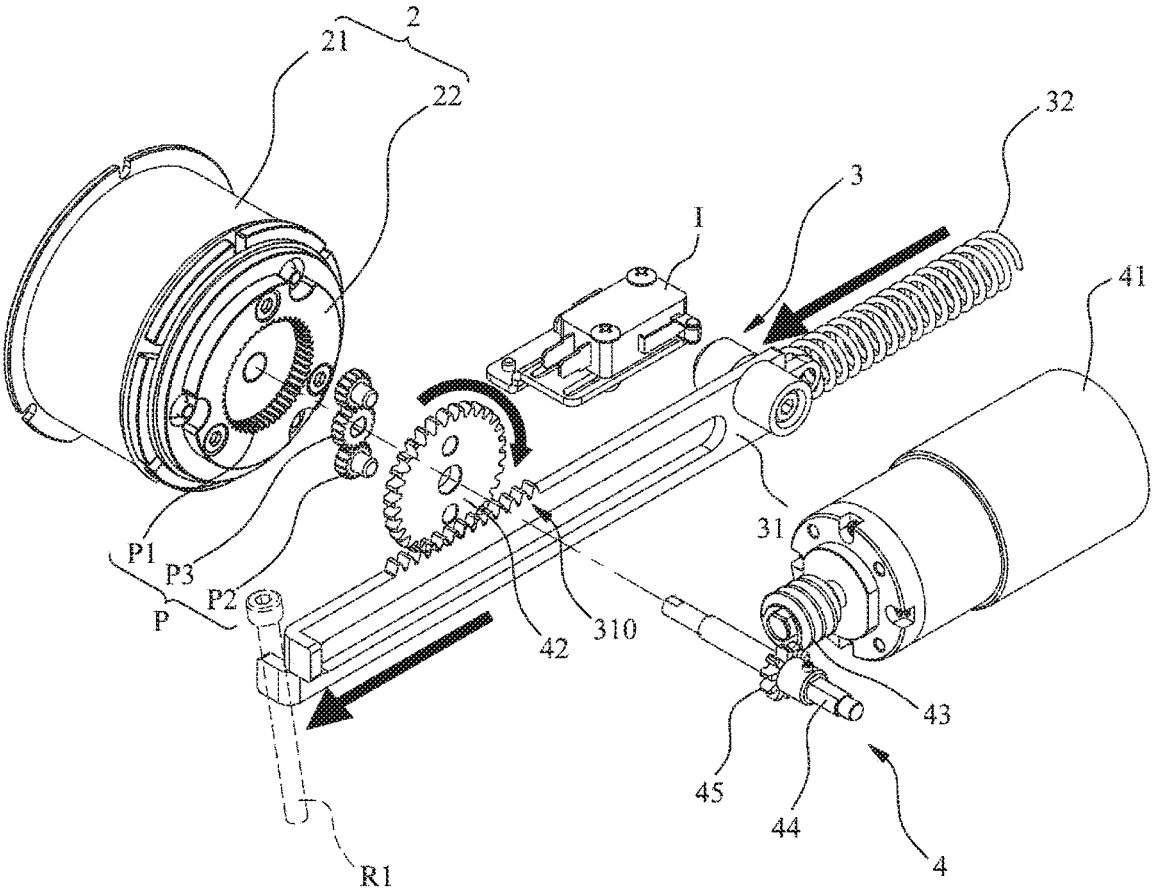
FIG. 4 is an exploded view showing the main components of the device for releasing and resetting the fire and smoke barrier according to the first embodiment of the present invention.

Reference is made to FIG. 3 and FIG. 4, wherein FIG. 3 is a perspective view of the device for releasing and resetting the fire and smoke barrier according to the preferred embodiment of the present invention, and FIG. 4 is an exploded view showing the main components of the device for releasing and resetting the fire and smoke barrier according to the preferred embodiment of the present invention. As shown in the figures, the device for releasing and resetting the fire and smoke barrier of this embodiment mainly comprises an electromagnetic clutch module 2, a push rod ejecting module 3 and a push rod resetting module 4. The electromagnetic clutch module 2 comprises an electromagnetic attraction unit 21 and a clutch member 22. When the electromagnetic clutch module 2 is electrically energized, the clutch member 22 can be attracted. When the electromagnetic clutch module 2 is electrically deenergized, the clutch member 22 is detached from the electromagnetic clutch module 2.

The push rod ejecting module 3 includes a push rod 31 and a compression spring 32. The push rod 31 is provided with a rack portion 310, and the compression spring 32 is capable of storing an elastic potential energy and is abutted against the push rod 31. The push rod resetting module 4 of this embodiment includes a motor 41, a resetting gear 42, a worm 43 and a resetting shaft 44. The resetting shaft 44 is provided with a worm gear 45. The worm 43 is connected to the motor 41 and engaged with the worm gear 45. The resetting gear 42 is fitted on the resetting shaft 44, but the resetting gear 42 is rotatable with respect to the resetting shaft 44.

A planetary gear set P shown in the figure includes a ring gear P1, two planetary gears P2 and a sun gear P3. The ring gear P1 is disposed on the clutch member 22, the two planetary gears P2 are pivotally connected to an end face of the resetting gear 42 and engaged with the ring gear P1, and the sun gear P3 is engaged with the two planetary gears P2 and connected to the resetting shaft 44.

The operation of the device for releasing and resetting the fire and smoke barrier of this embodiment will be described below. At the beginning, the device for releasing and resetting the fire and smoke barrier is in a deactivated state, and the clutch member 22 is attracted and held by the electromagnetic attraction unit 21. At this time, the planetary gear set P cannot be rotated so that the resetting gear 42 cannot be rotated. The push rod 31 is maintained in a home position, and the compression spring 32 is in a compressed state.

In case of emergency where the fire and smoke barrier needs to be released, the electromagnetic attraction unit 21 is powered off due to power failure caused by a fire accident or due to interruption of power supply caused by a fire control device of a building. The clutch member 22 is detached from the electromagnetic attraction unit 21 and becomes freely rotatable. At this time, the push rod 31 is ejected with aid of the elastic potential energy of the compression spring 32, and then the push rod 31 pushes the release lever R1 of the barrier release member R, thereby releasing the fire and smoke barrier. The specific operation of the release lever R1 for releasing the fire and smoke barrier will be described in detail later. With the movement of the push rod 31, the resetting gear 42 is rotated by the rack portion 310 so that the two planetary gears P2 roll around the center of the resetting gear 42. Since the sun gear P3 and the resetting shaft 44 are kept stationary, the clutch member 22 is rotated with rotation of the planetary gears P2.

When the emergency situation is terminated, the barrier release member R needs to be reset. In order to reset the barrier release member R, the motor 41 of the push rod resetting module 4 and the electromagnetic clutch module 2 are simultaneously and electrically energized. At this time, the clutch member 22 is attracted and held by the electromagnetic clutch module 2, and the motor 41 of the push rod resetting module 4 is activated to rotate the resetting shaft 44 via the worm 43 and the worm gear 45. The sun gear P3 is rotated by the resetting shaft 44 while the two planetary gears P2 roll around the sun gear P3. Because the clutch member 22 is held, rolling of the two planetary gears P2 causes the resetting gear 42 to rotate, thereby resetting the push rod 31 through the rack portion 310. The motor 41 is not deactivated until a limit switch I is trigged by the push rod 31.

The detailed construction of the clutch module C of the door operator is described below. As shown in FIG. 2, a main drive shaft 5 has one end coupled to the motor M and the other end coupled to the fire and smoke barrier (not shown) via the reducer module T. A sleeve 6 is externally fitted on the main drive shaft 5 and has one end which is coupled to a frame F in such a manner that the sleeve 6 is not rotated integrally with the main drive shaft 5 but is slidable in an axial direction with respect to the main drive shaft 5. A brake plate 51 is fixed on the main drive shaft 5 and is capable of rotating integrally with the main drive shaft 5.

The sleeve 6 is provided, on one side of the brake plate 51, with a brake pad 61 for applying a braking force to the brake plate 51. A brake pad attractor 7 is provided on the other side of the brake pad 61 and is fixed to the frame F. The brake pad attractor 7 of this embodiment is an electromagnetic attraction device, which is capable of attracting the brake pad 6 when being excited by an electric current. A brake spring S is externally fitted on the sleeve 6 and has one end abutted against the frame F and the other end abutted against the brake pad 61. In other words, the brake spring S storing an elastic potential energy is capable of elastically biasing the brake pad 61 and abutting the brake pad 61 against the brake plate 51 while the brake pad attractor 7 is capable of generating a magnetic attraction force for attracting the brake pad 61 against the elastic potential energy of the brake spring S.

The barrier release member R of this embodiment includes the release lever R1 and an actuator plate R2. One end of the release lever R1 corresponds to the push rod 31 of the push rod ejecting module 3, and the other end of the release lever R1 is connected to the actuator plate R2. The actuator plate R2 is located between the frame F and the sleeve 6. When the release lever R1 is operated, the sleeve 6 together with the brake pad 61 is axially moved with respect to the main drive shaft 5 by the actuator R2 so that the brake pad 61 is detached from the brake plate 51.

Figure 5A:
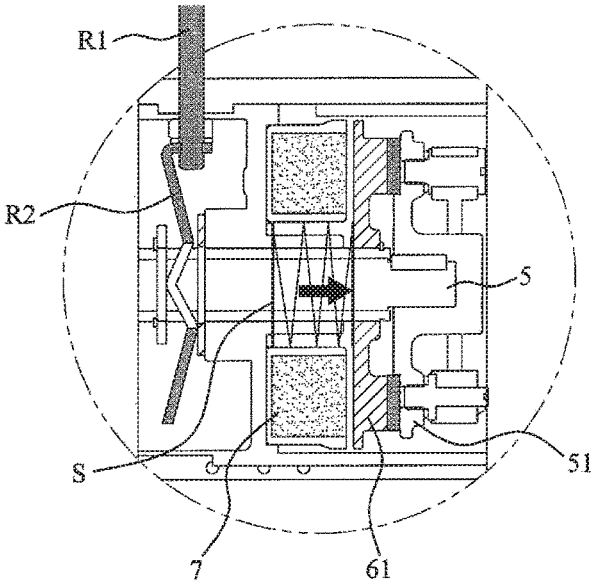
FIGS. 5A, 5B, and 5C are partially enlarged views of the encircled portion of FIG. 2, showing different operation states of a clutch module of the door operator according to the first embodiment of the present invention.

The operation of the clutch module C in use states of the door operator is described below with reference to FIG. 2 and FIG. 5A. When the door operator is normally used in a stationary state, the brake pad 61 is elastically biased against the brake plate 51 by the brake spring S, so that the brake plate 51 and the main drive shaft 5 are prevented from rotating due to the braking force.

Figure 5B:
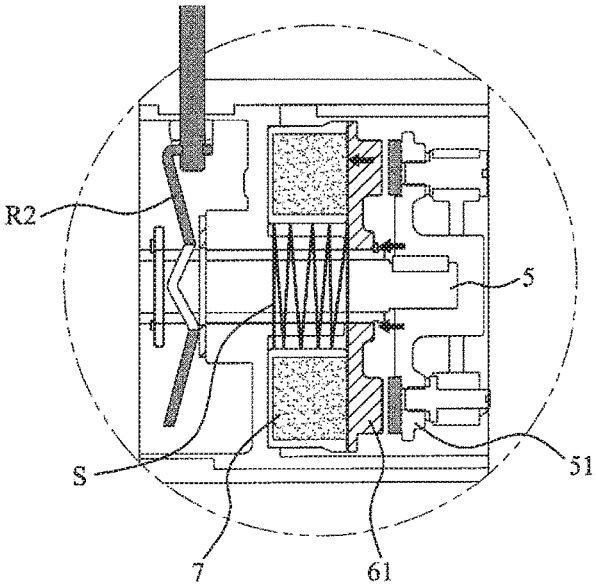

As shown in FIG. 5B, when the door operator is normally operated to open or shunt the fire and smoke barrier by means of the motor M, the brake pad attractor 7 is electrically energized to attract and retract the brake pad 61, that is, the magnetic attraction force of the brake pad attractor 7 overcomes the elastic potential energy of the brake spring S, so that the brake pad 61 is detached from the brake plate 51. At this time, the main drive shaft 5 can be freely rotated by the motor M, so that the main drive shaft 5 can be driven to open or shut the fire and smoke barrier.

Figure 5C:
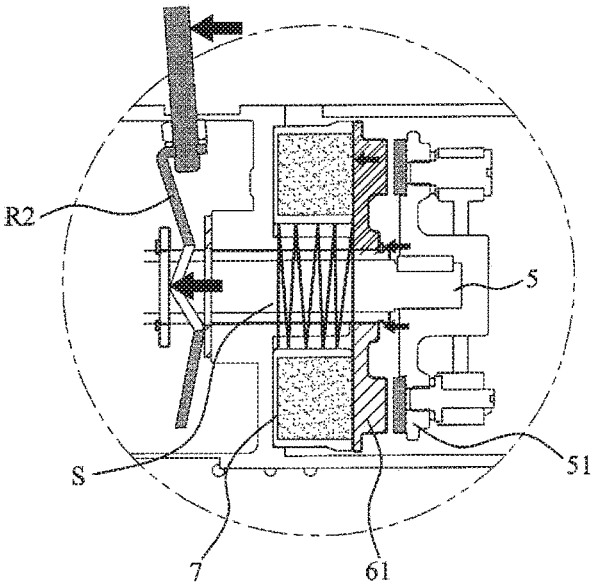

However, in case of disaster, the release lever R1 of the barrier release member R is pushed by the push rod 31 of the device 1 for releasing and resetting the fire and smoke barrier as shown in FIG. 2 and FIG. 5C, and the sleeve 6 together with the brake pad 61 is axially moved by the actuator plate R2 with respect to the main drive shaft 5, so that the brake pad 61 is detached from the brake plate 51. Once the brake plate 51 is separated from the brake pad 61, the main drive shaft 5 can be freely rotatable, and the fire and smoke barrier can fall down due to the gravity so as to shut the fire and smoke barrier.

In describing resetting of the barrier release member R, reference is made to FIG. 2 and FIG. 5C. In the case that the barrier release member R is to be reset, the device 1 for releasing and resetting the fire and smoke barrier cancels the force applied to the barrier release member R. That is, during the resetting of the push rod 31, the brake pad 61 together with the sleeve 6 is elastically biased by the brake spring S, so that the sleeve 6 is axially displaced in a direction toward the motor M. and the brake pad 61 is biased against the brake plate 51, thereby generating a braking force to the main drive shaft 5. At the same time, the release lever R1 is reset with the axial movement of the sleeve 6. That is, as shown in FIG. 2, the door operator is restored to the stationary state in which the door operator is normally used.

Figure 6:
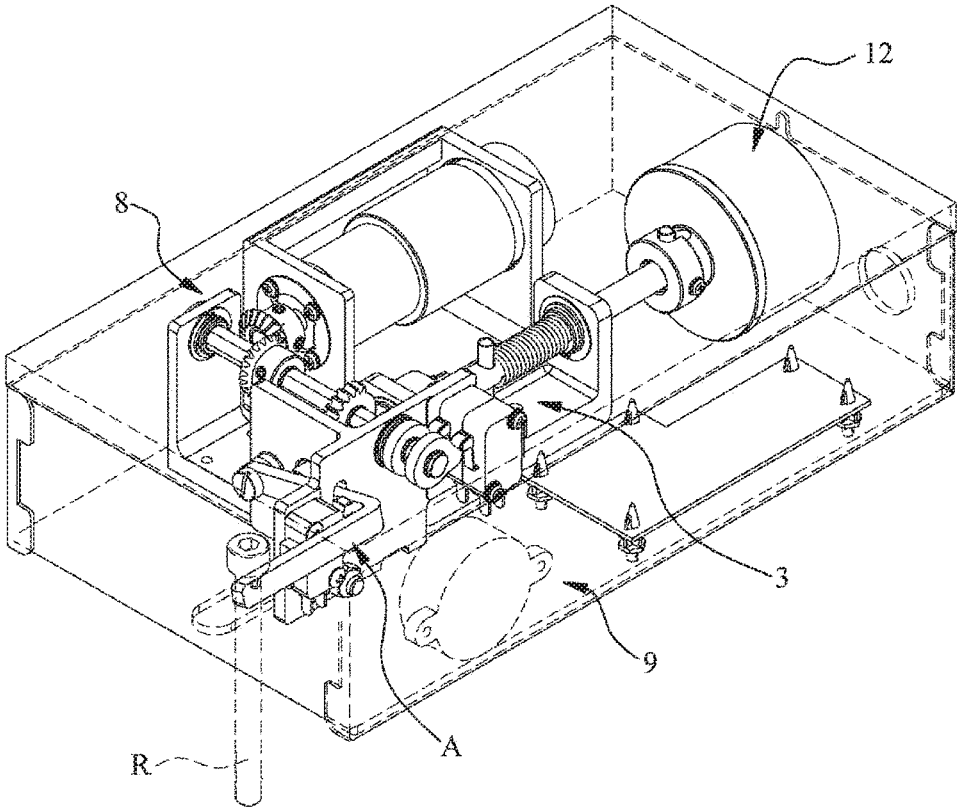
FIG. 6 is a perspective view of a device for releasing and resetting the fire and smoke barrier according to a second embodiment of the present invention.
Figure 7:
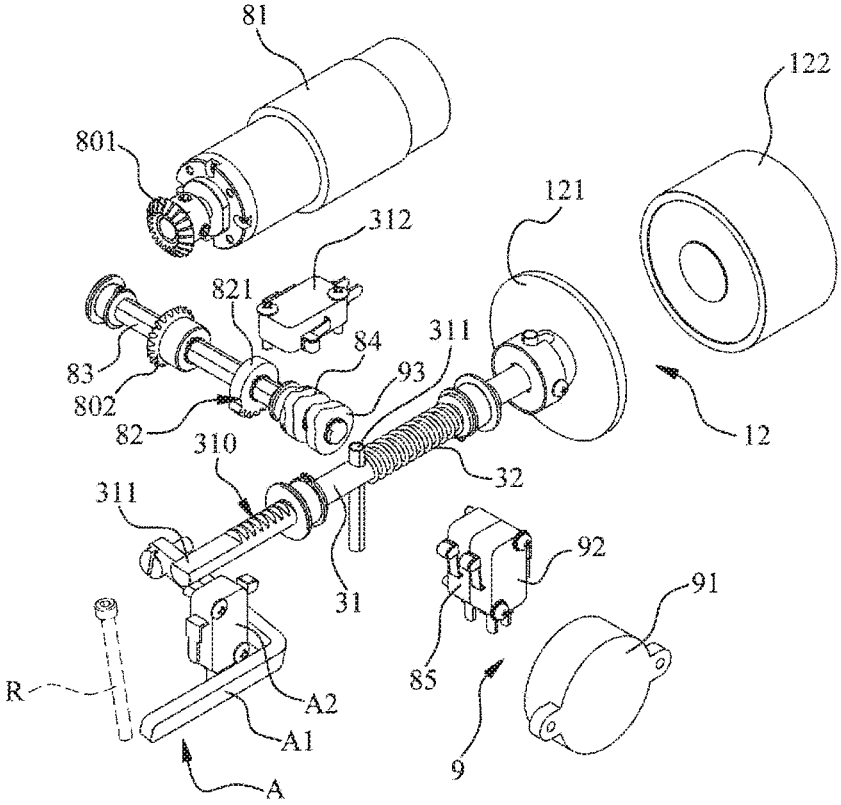
FIG. 7 is an exploded view showing the main components of the device for releasing and resetting the fire and smoke barrier according to the second embodiment of the present invention.

In describing the details of the configuration and operation of a second embodiment of the present invention, reference is made to FIG. 6 and FIG. 7. FIG. 6 is a perspective view of a device for releasing and resetting the fire and smoke barrier according to the second embodiment of the present invention, and FIG. 7 is an exploded view showing the main components of the device for releasing and resetting the fire and smoke barrier according to the second embodiment of the present invention.

As shown in the figures, this embodiment mainly comprises a push rod ejecting module 3, an electromagnetic holding module 12, an push rod resetting module 8, a warning module 9 and a push rod stopping module A. The push rod ejecting module 3 includes a push rod 31 and a compression spring 32. The push rod 31 is provided with a rack portion 310, and the compression spring 32 is abutted against the push rod 31 and stores an elastic potential energy sufficient to push the barrier release member R.

The electromagnetic holding module 12 includes a magnetically attractable plate 121 and an electromagnetic unit 122. The magnetically attractable plate 121 is disposed at the end of the push rod 31. When the electromagnetic unit 122 is electrically energized and magnetically excited due to electromagnetic effect, the magnetically attractable plate 121 is attracted by the electromagnetic unit 122, thereby holding the push rod 31.

The push rod resetting module 8 mainly includes a motor 81, a resetting gear 82, a first bevel gear 801, a second bevel gear 802, a transmission shaft 83, a second cam 84 and a second micro switch 85. The second bevel gear 802 is disposed on the transmission shaft 83, the first bevel gear 801 is connected to the motor 81 and engaged with the second bevel gear 802, and the resetting gear 82 is disposed on the transmission shaft 83 and engaged with the rack portion 310 of the push rod 31. Accordingly, when the first bevel gear 801 is rotated by the motor 81, the second bevel gear 802 together with the transmission shaft 83 is rotated by the first bevel gear 801, so that the resetting gear 82 is rotated to pull the push rod 31 back.

In this embodiment, the resetting gear 82 comprises an untoothed circumferential surface section 821 while a flat section 311 is provided at the front end of the push rod 31. The untoothed circumferential surface section 821 of the resetting gear 82 is so configured to not interfere the rack portion 310 when the push rod 31 is ejected. As such, the resetting gear 82, the first bevel gear 801 or the second bevel gear 802 can be prevented from being damaged by the push rod 31 ejected at high speed.

The flat section 311 at the front end of the push rod 31 is so configured to restrict the stroke distance of the push rod 31. As such, the magnetically attractable plate 121 is prevented from colliding with the electromagnetic unit 122 due to the excessive stroke distance. A spring (not shown) provided between the end of the push rod 31 and the magnetically attractable plate 121 serves as a cushion and capable of slightly adjusting a contact angle of the magnetically attractable plate 121 to the electromagnetic unit 122 so that the magnetically attractable plate 121 is in contact with the electromagnetic unit 122 in parallel so as to maintain an excellent attractive force.

The second cam 84 is mounted on the transmission shaft 83, and the second micro switch 85 is electrically connected to the motor 81. The second cam 84 is rotated integrally with the transmission shaft 83. If the second micro switch 85 is triggered by the second cam 84, the motor 81 would be deactivated.

The warning module 9 of this embodiment includes a buzzer 91, a first cam 93 and a first micro switch 92. The first micro switch 92 is electrically connected to the buzzer 91 for activating or deactivating the buzzer 91. The first cam 93 is mounted on the transmission shaft 83 and rotated integrally with the transmission shaft 83. If the first micro switch 92 is triggered by the first cam 93, the buzzer 91 would be deactivated.

Figure 8A:
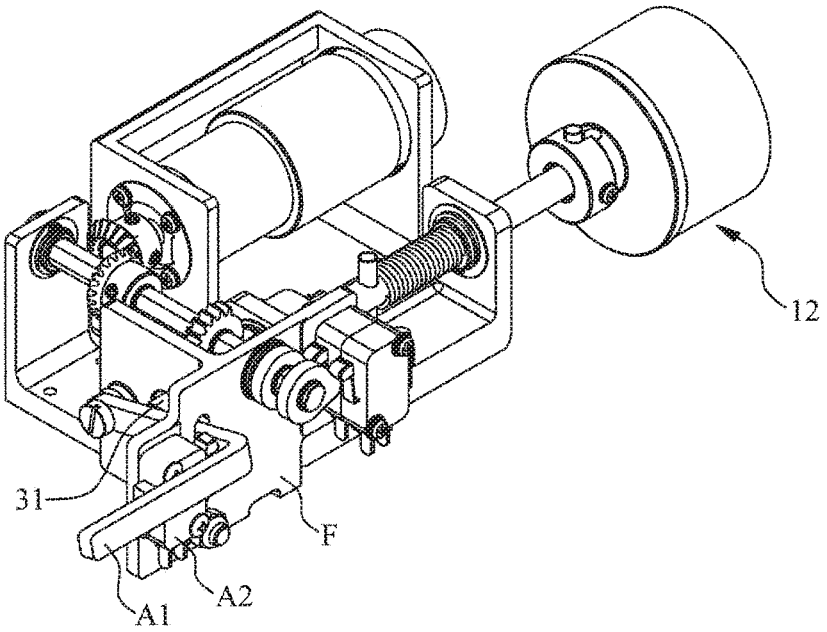
FIG. 8A is a perspective view of the device for releasing and resetting the fire and smoke barrier according to the second embodiment of the present invention before the device is installed.
Figure 8B:
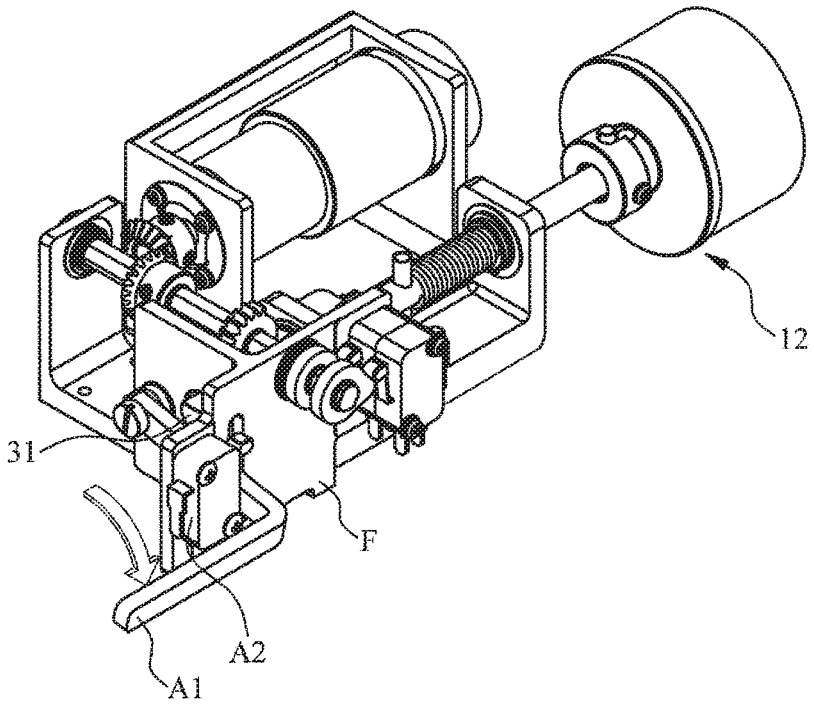
FIG. 8B is a perspective view of the device for releasing and resetting the fire and smoke barrier according to the second embodiment of the present invention after the device is installed.

In describing the push rod stopping module A, reference is made to FIG. 8A, which is a perspective view of the device for releasing and resetting the fire and smoke barrier according to the second embodiment of the present invention before the device is installed, and FIG. 8B, which is a perspective view of the device for releasing and resetting the fire and smoke barrier according to the second embodiment of the present invention after the device is installed. The push rod stopping module A of this embodiment includes a stop lever A1 and a third micro switch A2. The stop lever A1 is hinged to the frame F at one end, and the push rod 31 can be selectively blocked by swinging the stop lever A1, as shown in FIG. 8A. In the case that the push rod 31 is not blocked by the stop lever A1, the push rod 31 can be ejected by the compression spring 32. The third micro switch A2 is electrically connected to the buzzer 91 (as shown in FIG. 7).

Accordingly, the push rod stopping module A of the present embodiment is provided to block the push rod 31 because the electromagnetic holding module 12 is not electrically energized and cannot attract and hold the push rod 31 before the device is installed. After the device is installed, the electromagnetic holding module 12 is electrically energized and thus can hold the push rod 31. In this case, the stop lever A1 has to be swung down to not interfere the push rod 31. If the stop lever A1 is not swung down, the third micro switch A2 would be continuously triggered by the stop lever A1, causing the buzzer 91 to continuously generate an alarm sound.

Figure 9A:
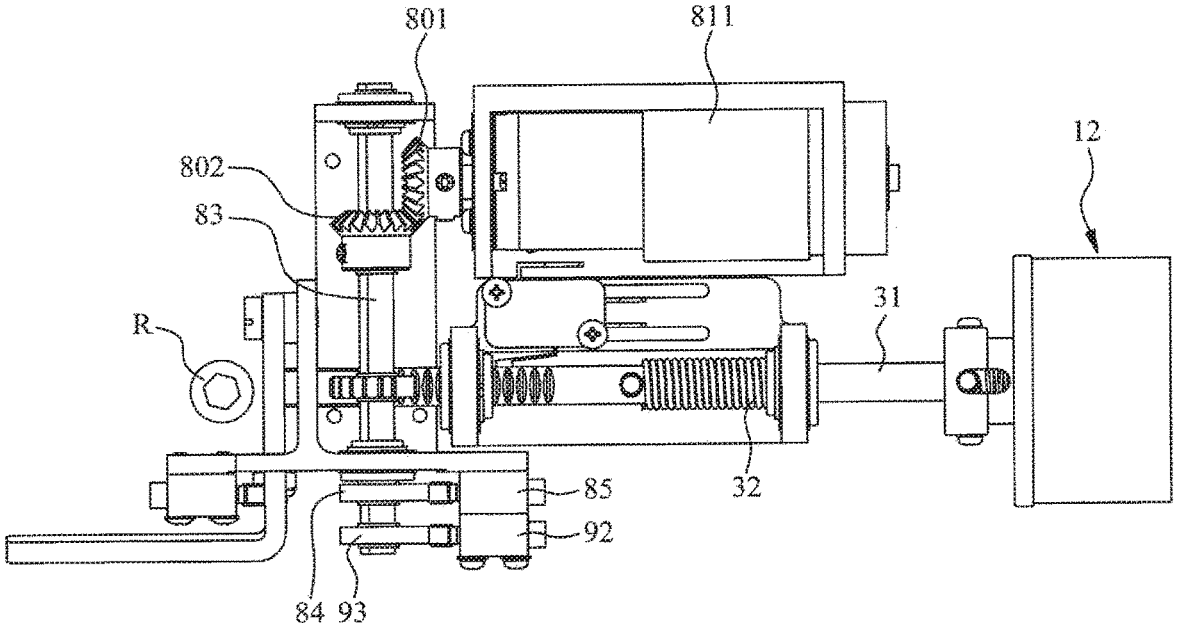
FIG. 9A is a top view showing the device for releasing and resetting the fire and smoke barrier according to the second embodiment of the present invention in a normal state.

The operation of this embodiment will be described in detail below. Reference is made to FIG. 9A, which is a top view showing the device for releasing and resetting the fire and smoke barrier according to the second embodiment of the present invention in a normal state. In the normal state (in which electrical power is supplied), the push rod 31 is attracted and held by the electromagnetic holding module 12, so that the compression spring 32 is compressed. At this time, the second micro switch 85 is triggered by the second cam 84 so as to deactivate the motor 81, and the first micro switch 92 is triggered by the first cam 93 so as to deactivate the buzzer 91.

Figure 9B:
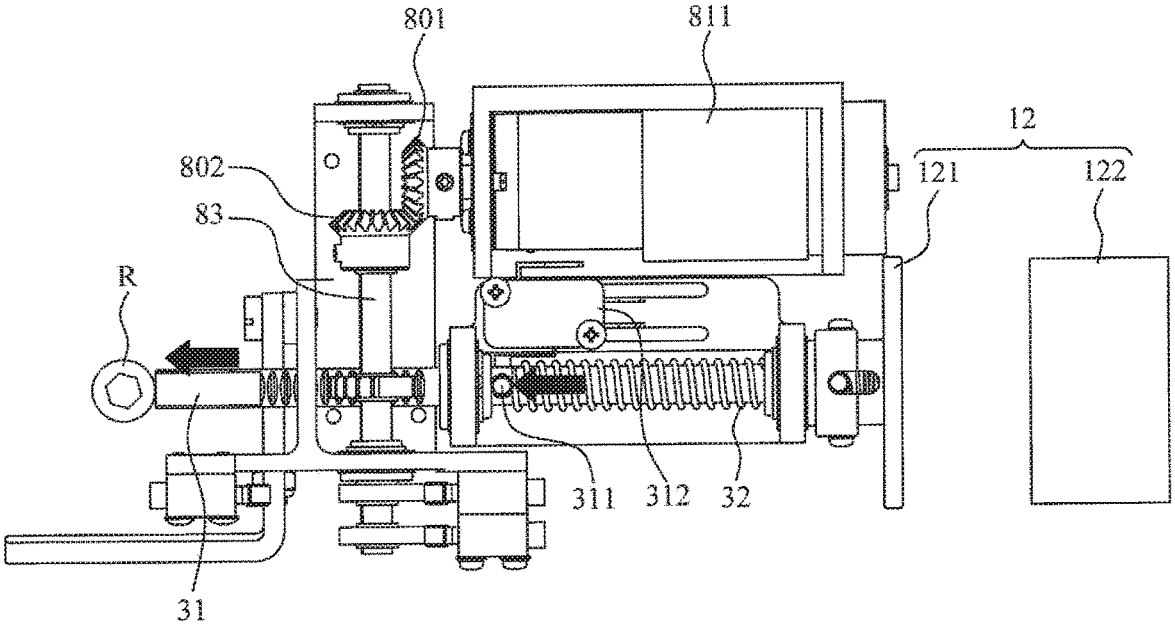
FIG. 9B is a top view showing the device for releasing and resetting the fire and smoke barrier according to the second embodiment of the present invention in a power failure state.

Reference is made to FIG. 9B, which is a top view showing the device for releasing and resetting the fire and smoke barrier according to the second embodiment of the present invention in a power failure state. In case of emergency, for example, in case of fire, the electrical power supplied to the device is interrupted, and the electromagnetic unit 122 is unable to attract and hold the magnetically attractable plate 121. At this time, the push rod 31 is ejected by the compression spring 32 so as to push the barrier release member R. A fourth micro switch 312 electrically connected to the motor 81 is triggered by a stud 311 on the push rod 31. Accordingly, when the power supply is restarted, the motor 81 would be activated by the fourth micro switch 312 so as to pull the push rod 31 back.

Figure 10A:
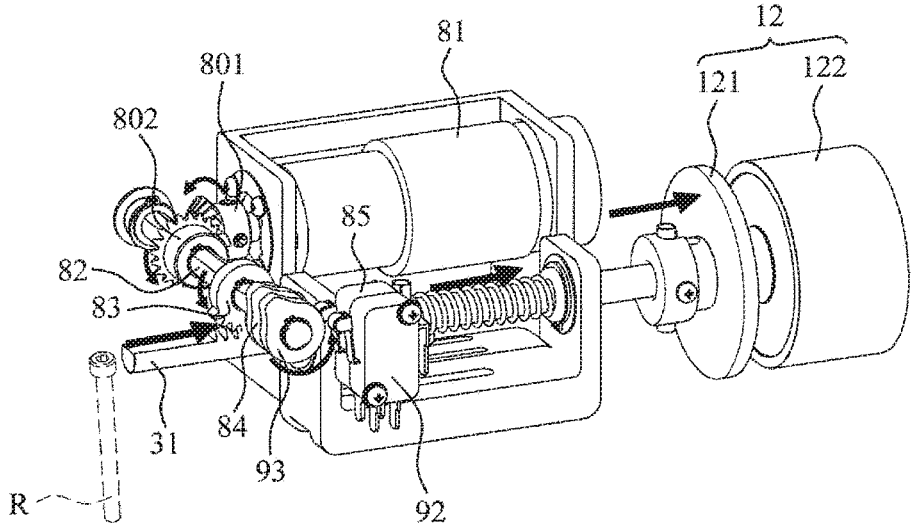
FIG. 10A is a perspective view showing the device for releasing and resetting the fire and smoke barrier according to the second embodiment of the present invention in a power restoration state.
Figure 10B:
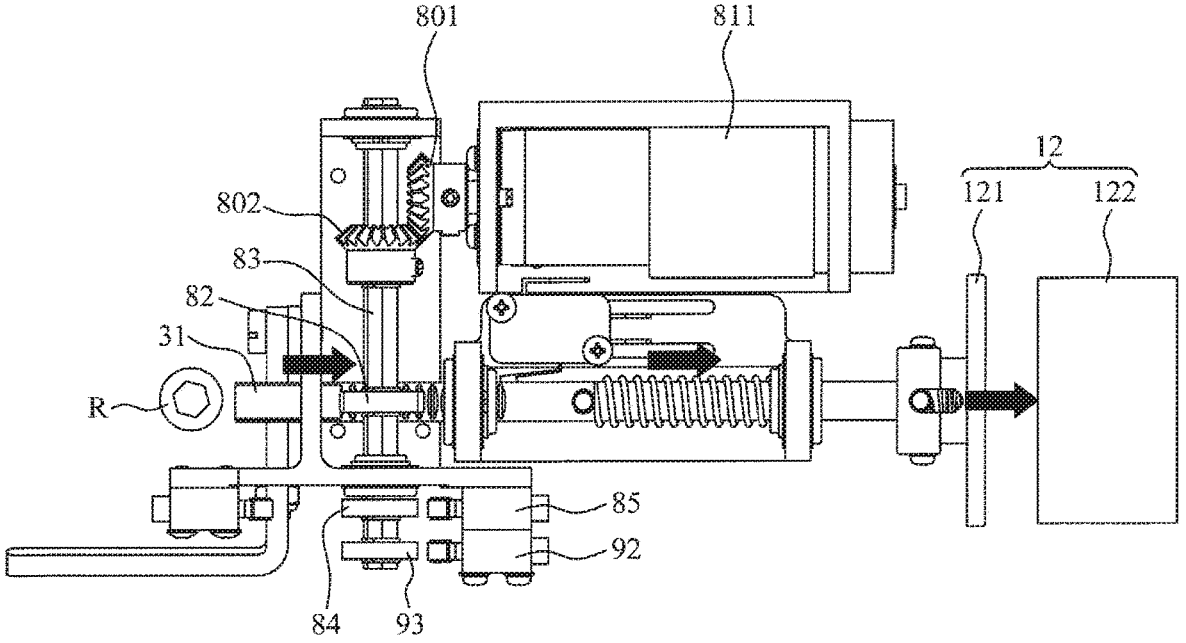
FIG. 10B is a top view showing the device for releasing and resetting the fire and smoke barrier according to the second embodiment of the present invention in a power restoration state.

Reference is made to FIG. 10A and FIG. 1B which are, respectively, a perspective view and a top view showing the device for releasing and resetting the fire and smoke barrier according to the second embodiment of the present invention when the power supply is restarted. When the power supply is restarted, the motor 81 is activated by the fourth micro switch 312. The transmission shaft 83 is rotated by the motor 81 via the first bevel gear 801 and the second bevel gear 802, thereby causing the resetting gear 82 to pull the push rod 31 back.

Once the transmission shaft 83 starts to rotate, the first cam 93 and the second cam 84 rotated integrally with the transmission shaft 83 stop triggering the first micro switch 92 and the second micro switch 85 respectively. At this time, the buzzer 91 (as shown in FIG. 7) is activated by the first micro switch 92 and generates an alarm sound to inform a nearby person that the device is being in operation. On the other hand, when the push rod 31 is pulled back to the initial position and the magnetically attractable plate 121 is attracted and held by the electromagnetic unit 122, the first micro switch 92 is triggered by the first cam 93 so as to deactivate the buzzer 91, and the second micro switch 85 is triggered by the second cam 84 so as to deactivate the motor 81.

It should be understood that the embodiments have been described for illustrative purposes and are not limiting. Accordingly, it is intended that the invention not be limited to the disclosed embodiments, but that it have the full scope permitted by the language of the following claims.

What is claimed is:

1. A device for releasing and resetting a fire and smoke barrier, which is used for actuating a barrier release member, the device comprising:

an electromagnetic clutch module, comprising an electromagnetic attraction unit and a clutch member, the electromagnetic attraction unit being provided to attract and hold the clutch member;

a push rod ejecting module, coupled to the clutch member and storing an elastic potential energy sufficient to push the barrier release member;

a push rod resetting module, coupled to the clutch member and provided to reset the push rod ejecting module;

wherein when the electromagnetic attraction unit is electrically deenergized, the clutch member is released by the electromagnetic attraction unit, and the barrier release member is pushed by the push rod ejecting module with aid of the elastic potential energy; when the push rod resetting module and the electromagnetic clutch module are electrically energized, the clutch member is attracted and held by the electromagnetic attraction unit, and the push rod ejecting module is reset by the push rod resetting module.

2. The device of claim 1, wherein the push rod resetting module includes a motor and a resetting gear, the push rod ejecting module includes a push rod and a compression spring, the push rod is provided with a rack portion, and the compression spring stores the elastic potential energy and is abutted against the push rod; the motor is coupled to the resetting gear, the resetting gear is engaged with the rack portion of the push rod; and when the resetting gear is rotated by the motor, the push rod is biased against the elastic potential energy by the resetting gear.

3. The device of claim 2, wherein the push rod resetting module further includes a worm and a resetting shaft, the resetting shaft is provided with a worm gear, the worm is connected to the motor and engaged with the worm gear, and the resetting gear is fitted on the resetting shaft.

4. The device of claim 3, further comprising a planetary gear set, which includes a ring gear, a plurality of planetary gears and a sun gear, wherein the ring gear is disposed on the clutch member, the plurality of planetary gears are pivotally connected to a lateral end face of the resetting gear and engaged with the ring gear, the sun gear is engaged with the plurality of planetary gears and connected to the resetting shaft.

5. The device of claim 4, wherein when the electromagnetic attraction unit is electrically deenergized, the push rod is biased by the elastic potential energy of the compression spring so that the resetting gear is rotated, the plurality of planetary gears are rotated by the resetting gear, and thus the clutch member is rotated; when the push rod resetting module and the electromagnetic clutch module are electrically energized, the resetting shaft is rotated by the motor via the worm and the worm gear, and the plurality of planetary gears and the resetting gear are driven by the sun gear so as to reset the push rod.

6. A device for releasing and resetting of a fire and smoke barrier, which is used for actuating a barrier release member, the device comprising:

a push rod ejecting module, storing an elastic potential energy sufficient to push the barrier release member;

an electromagnetic holding module, coupled to the push rod ejecting module; and a push rod resetting module, coupled to the push rod ejecting module;

wherein when the electromagnetic holding module is electrically deenergized, the barrier release member is pushed by the push rod ejecting module with aide of the elastic potential energy; when the push rod resetting module and the electromagnetic holding module are electrically energized, the push rod ejecting module is reset by the push rod resetting module; the push rod ejecting module is attracted and held by the electromagnetic holding module.

7. The device of claim 6, wherein the push rod resetting module includes a motor and a resetting gear, the push rod ejecting module includes a push rod and a compression spring, the push rod is provided with a rack portion, and the compression spring stores the elastic potential energy and is abutted against the push rod; the motor is coupled to the resetting gear, the resetting gear is engaged with the rack portion of the push rod; and when the resetting gear is rotated by the motor, the push rod is biased against the elastic potential energy by the resetting gear.

8. The device of claim 7, wherein the push rod resetting module further includes a first bevel gear, a second bevel gear and a transmission shaft, the second bevel gear is disposed on the transmission shaft, the first bevel gear is connected to the motor and engaged with the second bevel gear, and the resetting gear set is disposed on the transmission shaft.

9. The device of claim 8, further comprising a warning module, wherein the warning module includes a buzzer, a first cam and a first micro switch, the first micro switch is electrically connected to the buzzer, the first cam is disposed on the transmission shaft; the push rod resetting module further includes a second cam and a second micro switch, the second cam is disposed on the transmission shaft, the second micro switch is electrically connected to the motor, wherein when the push rod ejecting module is reset by the push rod resetting module, the first cam and the second cam are rotated by the transmission shaft; when the first micro switch is triggered by the first cam, the buzzer is turned on or off, and when the second micro switch is triggered by the second cam, the motor is turned off.

10. The device of claim 9, further comprising a push rod stopping module, which includes a stop lever and a third micro switch, wherein the stop lever is capable of selectively blocking a front end of the push rod or unblocking the front end of the push rod so that the barrier release member is able to be actuated; when the front end of the push rod is blocked, the third micro switch is triggered so as to turn on the buzzer.

* * * * *